United States Patent [19]

Farrell

[11] 4,091,792

[45] May 30, 1978

[54] GRINDING WHEEL DRESSER UNIT WITH IMPROVED HEAT TRANSFERRING CAPABILITY

[75] Inventor: Thomas Michael Farrell, Cincinnati, Ohio

[73] Assignee: Cincinnati Milacron Inc., Cincinnati, Ohio

[21] Appl. No.: 781,161

[22] Filed: Mar. 25, 1977

[51] Int. Cl.[2] ..... B24B 53/12

[52] U.S. Cl. ..... 125/11 CS

[58] Field of Search ..... 125/11 R, 11 N, 11 CS

[56] References Cited

U.S. PATENT DOCUMENTS

| | | | |
|---|---|---|---|
| 2,451,395 | 10/1948 | Klukan | 125/11 CS |
| 2,581,544 | 1/1952 | Loecy, Jr. | 125/11 N |
| 3,003,492 | 10/1961 | Grove | 125/11 CS |
| 3,009,455 | 11/1961 | Price | 125/11 CS |

FOREIGN PATENT DOCUMENTS

| | | | |
|---|---|---|---|
| 833,538 | 4/1970 | United Kingdom | 125/11 CS |

*Primary Examiner*—Harold D. Whitehead
*Attorney, Agent, or Firm*—James D. Liles

[57] ABSTRACT

A wheel dresser unit has a housing with an internal fluid chamber, and a diamond dresser nib is mounted to the housing in thermal communication with the chamber. A thermally conductive fluid flows through a plurality of ports within the housing in thermal communication with the dresser nib, thus conducting heat from the dressing zone through the dresser nib and to the thermally conductive fluid, tending to cool the dresser nib.

7 Claims, 4 Drawing Figures

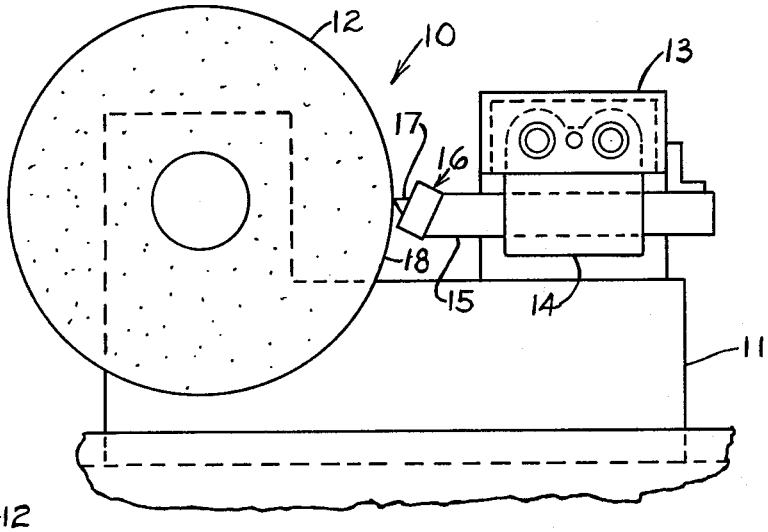
Fig. 1
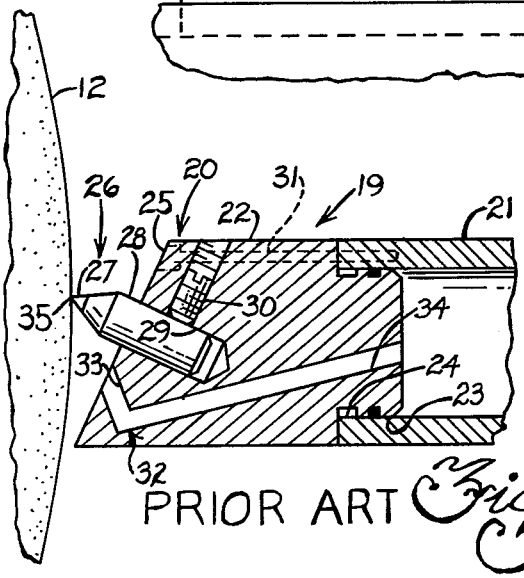
PRIOR ART Fig. 2
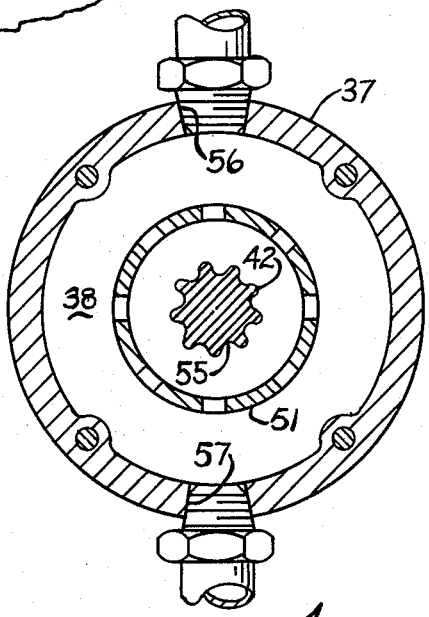
Fig. 4
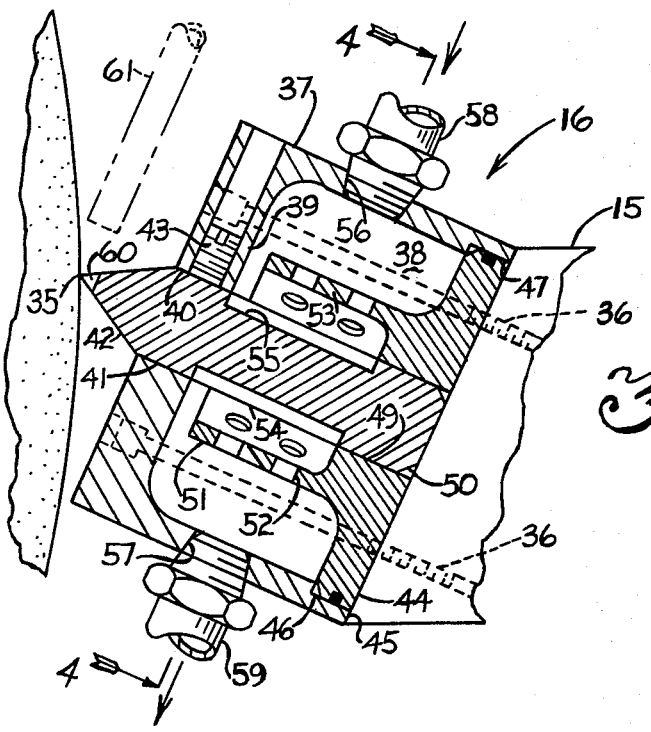
Fig. 3

GRINDING WHEEL DRESSER UNIT WITH IMPROVED HEAT TRANSFERRING CAPABILITY

BACKGROUND OF THE INVENTION

In grinding machines it is frequently desirable and necessary to condition or "dress" a grinding wheel surface at periodic intervals by means of passing a single point diamond dresser nib across a wheel surface. Dressing of the wheel cuts the matrix and fractures or tears out the dulled abrasive particles in the wheel face presenting fresh, sharp edges for continued cutting action.

The application of a single point diamond dresser nib to the wheel tends to create an area of high localized heat in the dressing zone, and overheating of the diamond tool may cause breakage or loss of diamond. The nib generally consists of a diamond embedded or bonded into a steel shank in the prior art. In order to cool the diamond to prevent overheating, the prior art devices teach that coolant fluid should be supplied on the wheel face so that there is a copious flow of coolant at all times around diamond contact at the wheel face, indicating that when this is not done, hot dry sparking of the diamond on the wheel, followed by plunging into the coolant may result in diamond breakage.

Some operations call for "dry grinding", especially where work must be visible during grinding. In these cases, dressing must also be done without coolant, and precautions must therefore be taken in allowing sufficient time to elapse between dressing passes in order to permit the diamond to cool.

One prior art diamond tool employs fins on the tool shank which extends from a housing to assist in cooling the tool. Another prior art device employs cross-drilled holes through the tool shank which extends from the tool holder with the expectation that an external coolant stream which impinges on the diamond contact point will be partially directed through the cross-drilled holes and assist in cooling. This latter prior art device tends to be much less effective when a dry grinding operation is performed than when wet grinding.

The within invention obviates the problems inherent in the prior art devices by design of a novel diamond dresser unit which purposefully conducts heat from a dressing zone through the diamond and diamond nib shank to an internal cavity in the dresser nib holder, where a closed circuit coolant fluid is circulated to efficiently carry away heat when either a dry or wet grinding operation is being performed.

It is therefore an object of the present invention to provide a grinding wheel dresser unit having improved heat transfer capabilities.

It is another object of the present invention to provide a heat-conducting wheel dresser system which may be effectively used when either dry or wet grinding operations are performed.

SUMMARY OF THE INVENTION

The invention is shown embodied in a grinding wheel dresser unit wherein a dresser housing is employed having a fluid chamber therewithin, and a diamond dresser nib, having a high thermal conductivity, is mounted to the housing in thermal communication with the chamber. A thermally-conductive fluid is adapted to flow through the chamber in thermal communication with the dresser nib, wherein the fluid enters and exits by means of fluid ports within the housing, creating a closed circuit of heat-transferring fluid.

DESCRIPTION OF THE DRAWINGS

FIG. 1 is a side elevation of a grinding machine employing a single point diamond dresser nib for conditioning a grinding wheel.

FIG. 2 is a side elevation in section of a prior art single point diamond dresser unit.

FIG. 3 is a side elevation in partial section of the wheel dresser unit of FIG. 1.

FIG. 4 is a section through the wheel dresser unit of FIG. 1, taken along line 4—4 of FIG. 3.

DESCRIPTION OF THE PREFERRED EMBODIMENT

Referring now to the drawings, and in particular FIG. 1 thereof, there is shown a grinding machine 10 having a wheelhead 11 which carrys a rotatable abrasive grinding wheel 12 and a wheel dressing mechanism 13 is carried on the wheelhead 11, as well. The dressing mechanism 13 has a carriage 14 and diamond bar 15 which are movable with respect to the grinding wheel 12 and the bar 15 carrys a heat-conducting wheel dressing unit 16 having a single point diamond dressing nib 17. The dressing nib 17 is traversed across the wheel 12 to condition, or "dress", the wheel surface 18 at predetermined time intervals.

A common prior art dressing device 19 is depicted in FIG. 2, wherein a wheel dressing unit 20 is affixed to a diamond bar 21, and the dressing unit 20 is comprised primarily of a cylindrical block 22, most often made of steel, having a pilot diameter 23 on one end which fits in a cooperating bore 24 of the diamond bar 21 for locating purposes. The block 22 has an angled face 25 on the other end proximal to the grinding wheel 12, and a diamond nib 26, consisting of a diamond 27 bonded to a substantially cylindrical shank 28, is carried in a smooth-fitting bore 29 in the angled face 25 of the block 22 so as to create a drag angle relative to the rotating grinding wheel 12 in a manner well-known in the art, to keep the diamond 27 sharp. The nib shank 28 is generally steel, and is secured in the bore 29 by a set screw 30 through the block 22 and, the block 22 is secured to the diamond bar 21 by screws 31. A coolant nozzle 32 is established by interdrilling ports 33,34 within the block 22 so that coolant fluid which may introduced through the hollow diamond bar 21 may pass through the ports 33,34 and be directed at the contact point of the diamond 27 with the wheel 12, i.e., the dressing zone 35. Here, it should be noted that the thermal conductivity, "$k$", in BTU per hour per square foot per degree F per foot, plays an important part. The thermal conductivity of diamond, $k_d$ is approximately 320, while that of steel, $k_s$, is approximately 26. Thus, it can be seen that the relatively low conductivity of steel of the prior art nib shank 28 tends to act as a barrier, impeding heat flow through the nib 26 and tending to keep the heat welled up at the dressing zone 35. Thus, it can be seen that in a dry grinding operation, the liklihood of overheating and ruination of the diamond 27 is increased.

FIG. 3 depicts a heat-conducting wheel dresser unit 16, which is affixed to a suitable diamond bar 15 by screws 36, wherein the dresser unit 16 has a generally cylindrical housing 37, having a cylindrical concentric cavity 38 terminating at a face portion 39 of the housing 37. A bore 40 is provided through the face portion 39 and a close-fitting diameter 41 of a diamond nib shank 42 is located in the bore 40 and the shank 42 is secured therewith by a transverse set screw 43 threadable in the plate portion 39. A support plate 44 is located at the rear face 45 of the housing 37, having a smooth-fitting diameter 46 located in a pilot bore 47 in the housing 37, and a seal ring 48 is provided about the diameter 46. The support plate 44 has a shank bore 49 therethrough, concentric with the housing bore 40, to support the rear end 50 of the diamond nib shank 42. The support plate 44 has an integral turbulence ring 51 extending into the cavity 38 to baffle the fluid, wherein the ring 51 is of cylindrical, thin-wall construction, with cross-drilled holes 52 through the wall 53. The unsupported portion 54 of the diamond nib shank 42, between the housing plate portion 39 and the rear support plate 44, has longitudinal grooves 55 provided to induce turbulence of cutting fluids and to increase the surface area of the shank 42. An inlet port 56 and outlet port 57 are provided in the housing 37 with suitable conduit connections 58,59 so that a relatively low-temperature coolant fluid may be introduced into the housing cavity 38 and exited through the outlet port 57. The coolant fluid will undergo turbulence when passing through and around the turbulence ring 51 and the diamond nib shank 42, thus tending to increase efficiency of heat transfer from the shank 42 to the fluid.

Since the diamond 60 has a relatively high conductivity, $k_d = 320$, it is desirable in practice to closely match the nib shank 42 with a similarly highly-conductive material, such as copper or a copper alloy (metal being preferable, because of structural qualities and strength). For example, when using copper, the copper has a conductivity $K_c$, of approximately 242, thus tending to make the diamond nib 17 act as a unitary heat conductor unit when compared to the prior art device of FIG. 1. As previously mentioned, the dressing zone 35 is a point of relatively high temperature, and when a correspondingly relatively low temperature coolant fluid is applied to the highly conductive nib 17 within the cavity 38, heat will tend to be biased from the high temperature dressing zone 35 to the low temperature coolant and will thus be conducted through the nib 17 and away from the diamond 60. In this manner therefore, a highly efficient and reliable method and apparatus for conductively cooling the diamond 60 at a dressing zone 35 is established, which is equally well-suited for either wet grinding or dry grinding operations. It can also be seen that coolant may be optionally supplied to the dressing zone 35 by external nozzle means 61 when wet grinding operations are performed, to assist in heat removal.

The section shown in FIG. 4 further illustrates in cross-section the dresser housing 37 with its inlet and outlet ports 56,57 and the concentric cavity 38, turbulence ring 51, and diamond nib shank 42 with turbulence-inducing grooves 55.

It is not intended to limit the invention to the specific embodiments shown herein, but rather it is intended that the invention includes all such modifications and designs as come within the scope of the appended claims.

What is claimed is:

1. A grinding wheel dresser unit, comprising in combination:
   (a) a dresser housing;
   (b) a closed coolant fluid chamber within said housing;
   (c) a diamond dressing nib supported upon the dresser housing;
   (d) means for conducting heat from said nib to said coolant chamber at a conduction rate substantially greater than that of steel;
   (e) a coolant fluid inlet port to the coolant chamber;
   (f) a coolant fluid outlet port from the coolant chamber, said outlet port being in fluid communication with said inlet port through the coolant chamber;
   (g) a closed conduit in fluid communication with the coolant chamber for transferring a coolant from a remote coolant source to said inlet port; and
   (h) an outlet conduit received by said outlet port for directing the coolant away from the nib and the dresser housing.

2. The unit of claim 1 further comprising turbulence-inducing means within said chamber.

3. The unit of claim 2 wherein said housing contains a bore which receives said shank; and a lock screw in said bore to secure said shank.

4. The unit of claim 2 wherein said turbulence-inducing means comprises baffles and shank grooves.

5. A unit as recited in claim 1 wherein said conducting means includes a shank supporting said nib and extending into said coolant chamber.

6. A unit as recited in claim 5 wherein said shank is generally cylindrical in shape and said coolant chamber encircles the periphery of said shank.

7. A unit as recited in claim 6 wherein the shank is principally constructed of a copper-bearing material.

* * * * *